United States Patent [19]

Stephan

[11] 4,406,599

[45] Sep. 27, 1983

[54] VARIABLE DISPLACEMENT VANE PUMP WITH VANES CONTACTING RELATIVELY ROTATABLE RINGS

[75] Inventor: Robert W. Stephan, Northville, Mich.

[73] Assignee: Vickers, Incorporated, Troy, Mich.

[21] Appl. No.: 202,502

[22] Filed: Oct. 31, 1980

[51] Int. Cl.[3] ..... F04C 2/00; F04C 15/04

[52] U.S. Cl. ..... 418/22; 418/26; 418/27; 74/109

[58] Field of Search ..... 418/16, 22–27, 418/159, 111; 74/29, 109

[56] References Cited

U.S. PATENT DOCUMENTS

| | | | |
|---|---|---|---|
| 1,545,516 | 7/1925 | Powell | 74/29 |
| 2,166,423 | 7/1939 | Clark | 60/384 |
| 2,426,491 | 8/1947 | Dillon | 418/24 |
| 2,570,411 | 10/1951 | Vickers | 418/159 |
| 2,685,842 | 8/1954 | Hufferd | 418/26 |
| 2,790,391 | 4/1957 | Holl | 418/13 |
| 2,967,488 | 1/1961 | Gardiner | 418/81 |
| 2,967,489 | 1/1961 | Harrington | 418/81 |
| 2,981,371 | 4/1961 | Pierce | 123/196 R |
| 3,103,893 | 9/1963 | Henning et al. | 418/27 |
| 4,259,039 | 3/1981 | Arnold | 418/26 |

FOREIGN PATENT DOCUMENTS

| | | | |
|---|---|---|---|
| 988511 | 5/1951 | France . | |
| 567845 | 7/1977 | U.S.S.R. | 418/16 |

*Primary Examiner*—John J. Vrablik

*Attorney, Agent, or Firm*—Barnes, Kisselle, Raisch, Choate, Whittemore & Hulbert

[57] ABSTRACT

A variable displacement vane pump is provided in which a pair of rings having oval-shaped inner contours are rotatably mounted in side-by-side relationship. The rings are adapted for relative rotation to each other from a first position wherein the inner contours are in register with each other and a moved position wherein the inner contours are out-of-register, and means are provided for effecting the relative rotation, which include a gear system operatively connected to the rings. A rotor member is mounted for rotation within the rings and is formed with a plurality of circumferentially spaced recesses which extend the entire axial length of the rotor. Each of the recesses carries a pair of vanes in abutting relationship. The vanes are mounted for radial movement in the recesses and are adapted for slidable contact with the inner contours of the rings. The vanes form two side-by-side rows of vanes with each row in tracking relationship with the inner contours of the rings. With the inner contours rotated to the first position, rotation of the vanes will pump a maximum volume of fluid through the pump and with the inner contours rotated to the moved position, the vanes will pump a reduced volume of fluid through the pump.

11 Claims, 14 Drawing Figures

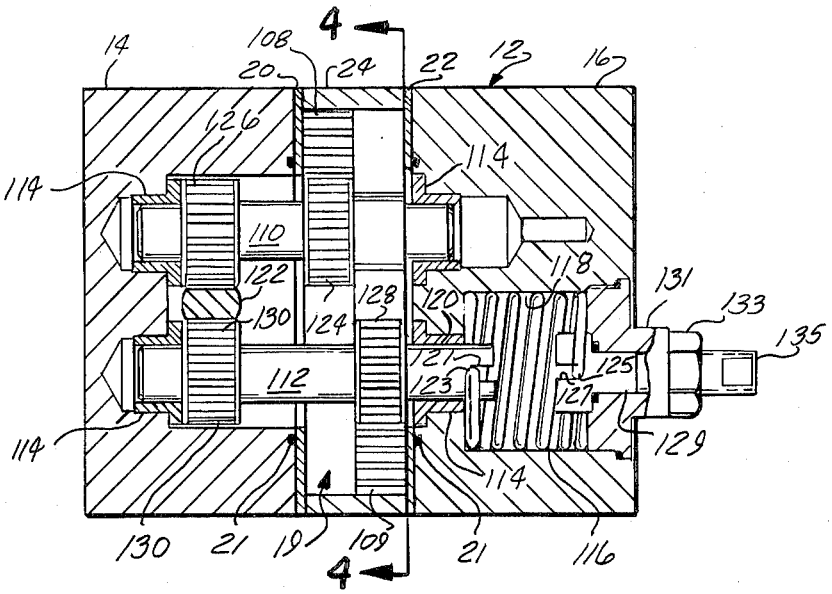
Fig-2
Fig-3
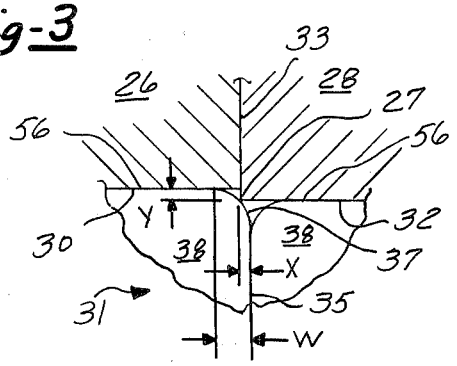
Fig-3A
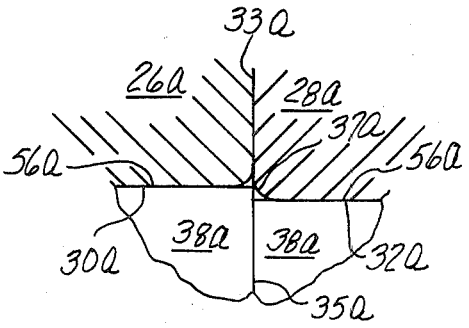

VARIABLE DISPLACEMENT VANE PUMP WITH VANES CONTACTING RELATIVELY ROTATABLE RINGS

This invention relates to power transmission of the type comprising two or more fluid pressure energy translating devices, one of which operates as a pump and another as a fluid motor.

The invention is more particularly concerned with a vane pump of the variable displacement type.

BACKGROUND AND SUMMARY

A vane pump construction of the type referred to above is disclosed in U.S. Pat. No. 2,570,411 issued to H. F. Vickers.

The Vickers' pump disclosed in the above mentioned patent includes a pumping cartridge comprising a three-part rotor and a pair of duplicate liner rings having oval cylindrical inner surfaces surrounding the three-part rotor. The liner rings are mounted for conjoint rotation between a pair of flange bushings.

The three-part rotor includes two identical main rotor elements journaled in the bushings and a separator disc mounted between the rotor elements and having a peripheral portion extending into a recess provided in the rings. The rotor elements are provided with a plurality of recesses each of which carries a radially slidable vane forming two rows of vanes, one row on each side of the separator disc with the radially outermost tips of the vanes, maintained by fluid pressure, in slidable contact with the inner contour of the rings. The separator disc functions to maintain the vanes in axial alignment with their respective rings.

Means are provided for manual rotary adjustment of the rings from a first position in which the inner contours of the rings are in register with each other for pumping full capacity through the cartridge, to a second position in which the inner contours are again in register with each other but transposed from the first position for pumping full capacity through the cartridge in an opposite direction.

However, it is believed that the pumping cartridge with the three-part rotor design described above has certain disadvantages. Among the disadvantages are the multiplicity of parts leading to increased leakage paths resulting in low volumetric efficiency; low overall efficiency; and high manufacturing costs.

The volumetric efficiency of a pump is defined as the ratio of actual output of the pump in gallons per minute to the theoretical or design output of the pump. The actual pump output is reduced because of internal fluid leakage. As pressure increases, the leakage of fluid from the outlet back to the inlet and/or tank increases and volumetric efficiency decreases.

The overall efficiency of a pump is defined as a ratio of the output hydraulic horsepower of the pump to the input horsepower of the pump drive. Hydraulic horsepower is defined as the product of fluid flow in gallons per minute; the fluid pressure in pounds per square inch; and a constant coversion factor of seven ten thousandths (0.0007). The overall efficiency reflects the internal power losses in a pump due to leakage and friction between the moving parts. An increase in leakage or friction will reduce the overall efficiency of the pump.

The multiplicity of parts in the above noted pumping cartridge results in an axial tolerance build-up inherent in the three-part construction. If the parts of the cartridge are toleranced to insure rotatability of the rings, the efficiency of the pump is reduced to unacceptable levels as compared to a comparable conventional fixed displacement vane pump. This reduction in efficiency is due to excess fluid leakage between the parts. Additionally, the pump efficiency is believed to be affected by turbulence of the fluid flow between adjacent pumping chambers which is induced by the presence of the separator disc therebetween.

It is an object of the present invention to provide a variable displacement vane pump wherein the full displacement volumetric and overall efficiencies approach that of a comparable conventional fixed displacement vane pump.

It is another object of the present invention to provide a variable displacement vane pump wherein the liner rings are readily rotatable relative to each other.

Still another object of the present invention is to provide a variable displacement vane pump operable in a pressure compensated mode.

To this end, a variable displacement vane pump is provided which includes a casing having an inlet and an outlet. A cavity is formed in the casing between the inlet and the outlet. A pair of rings having oval-shaped inner contours are rotatably mounted in the cavity in side-by-side relationship. The rings are adapted for relative rotation to each other between a first position wherein the inner contours are in register and a moved position wherein the inner contours are out-of-register. Means are provided, operatively connected to the rings, for effecting their relative rotation. A rotor having a plurality of circumferentially spaced recesses is mounted in the cavity for rotation within the rings. A pair of vanes are movably mounted in abutting relationship in each of the recesses and are adapted for slidable contact with the inner contours of the rings.

These and other objects and features of my invention will become apparent with reference to the following description and drawings taken together with the appended claims.

DESCRIPTION OF THE DRAWINGS

FIG. 2 is a cross-sectional view taken along line 2—2 of FIG. 1;

FIG. 3 is an enlarged diagrammatic partial sectional view showing the liner rings and vanes of FIG. 1;

FIG. 3A is an enlarged diagrammatic partial sectional view showing a modification of the liner rings and vanes of FIG. 3;

DESCRIPTION

Figure 1:
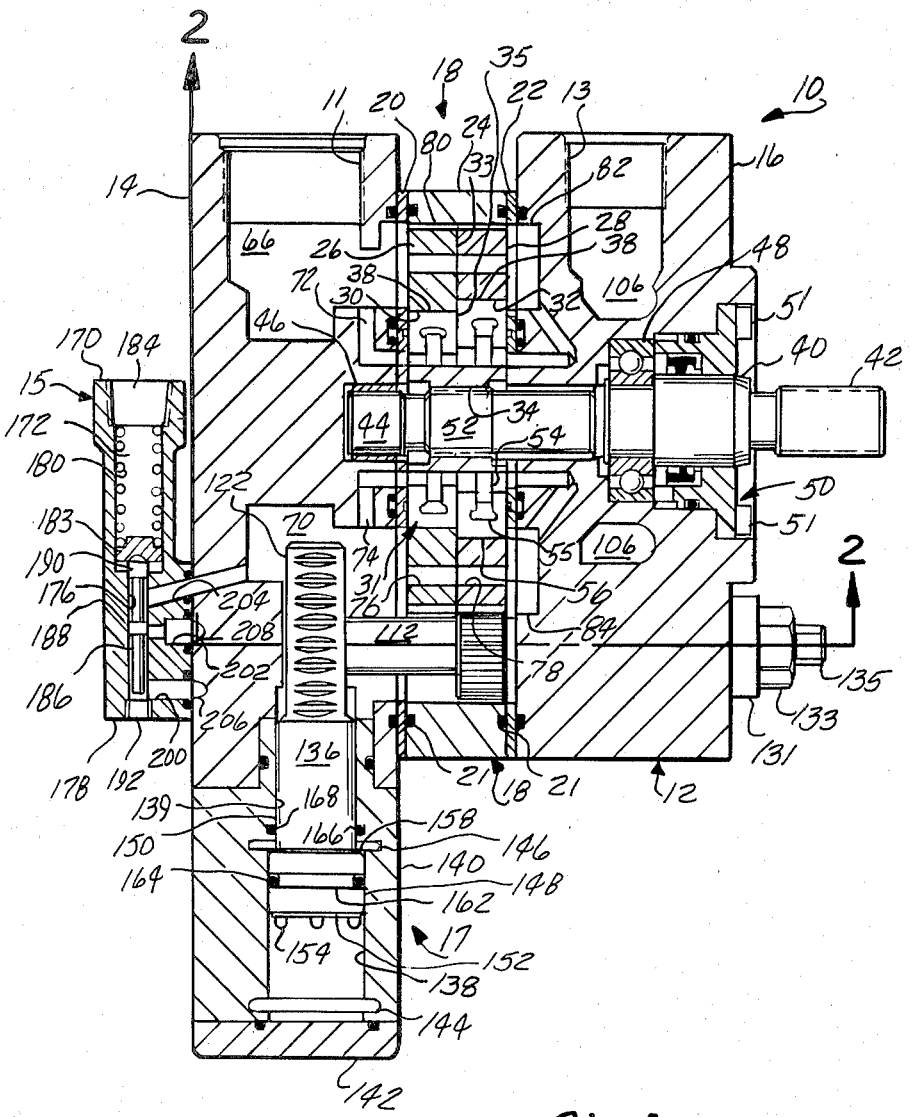
FIG. 1 is a diagrammatic cross-sectional view of a variable displacement vane pump embodying the instant invention.

In a preferred embodiment of my invention, a variable displacement vane pump 10, FIG. 1, comprises a pump casing 12 which includes an inlet member 14 and an outlet member 16. The vane pump is adapted for connection to an external supply or tank line and a discharge line, not shown, through inlet and outlet openings 11 and 13 formed in inlet and outlet members 14 and 16. A pumping element cartridge 18 is positioned between the inlet and outlet members 14, 16 of casing 12. A compensator control valve 15 and a piston assembly 17, mounted on inlet member 14, are operable to vary the displacement of vane pump 10 through a gear system 19, FIG. 2, mounted within casing 12. Inlet member 14, outlet member 16, and cartridge 18 are held together by conventional fastening means such as bolts, not shown, as are compensator control 15 and piston assembly 17. Suitable fluid sealing elements 21, such as O-rings are positioned between the interface of the various elements of pump 10.

The cartridge 18 includes a hollow center housing or spacer 24; a pair of generally rectangularly-shaped plate members 20 and 22; a pair of generally cylindrically-shaped rings 26 and 28 having oval-shaped inner contours 30 and 32 and side faces 33; and a cylindrically-shaped pump rotor 34 having a plurality of generally rectangularly-shaped vanes 38 mounted therein. The plates 20, 22 are mounted in spaced-apart relationship by spacer 24. The rings 26, 28 are mounted within spacer 24 between plates 20, 22 in side-by-side relationship at adjoining side faces 33 forming a cavity 31 extending between plates 20, 22. Rings 26, 28 are adapted for relative rotation to each other within spacer 24.

Figure 4:
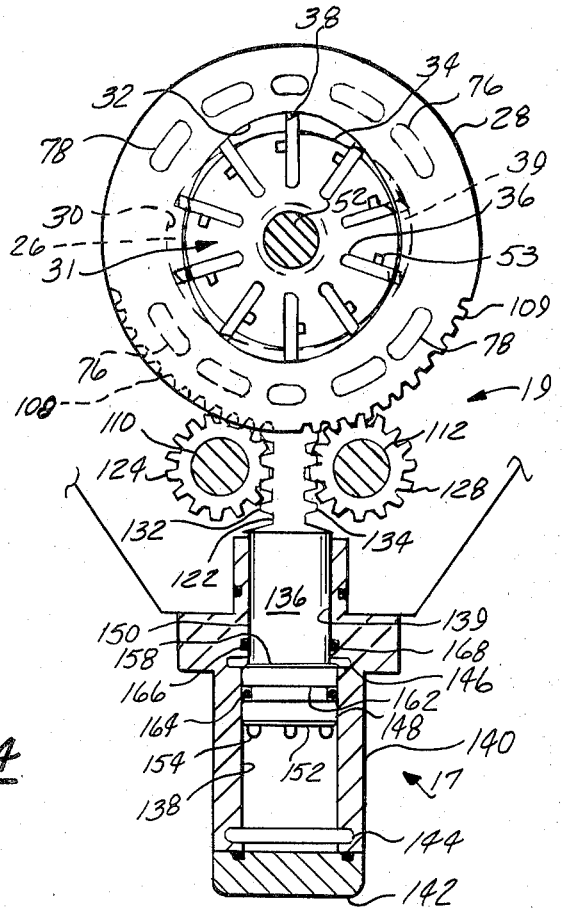
FIG. 4 is a partial sectional view taken along line 4—4 of FIG. 2 showing the gearing arrangement with details of the casing removed for sake of clarity.

Pump rotor 34 is formed with a plurality of circumferentially-spaced slots or recesses 36, FIG. 4, and is mounted within cavity 31 for rotation within the inner contours 30, 32 of the rings. Each of the slots 36 extends along the entire axial length of rotor 34 and carry a pair of the vanes 38 in abutting relationship along abutting surfaces 35. Vanes 38 are mounted for radial movement in recesses 36 and are adapted for slidable contact with inner contours 30, 32. The vanes form two side-by-side rows of vanes with each row in tracking relationship with the inner contour of one of the rings 26, 28 for slidable contact therewith. A plurality of adjoining pumping chambers 39, FIG. 4, are thus formed between vanes 38, rotor 34, inner contours 30, 32, and plates 20, 22.

A pump shaft 40 having a driven end 42 adapted for connection to a prime mover, not shown, and a free end 44, extends through the outlet member 16 and the cartridge 18 with free end 44 journaled in a sleeve bearing 46 arranged in the inlet member 14. The driven end 42 is mounted in a ball-bearing element 48 arranged in the outlet member 16 adjacent to a suitable oil seal 50. Bearing element 48 and seal 50 are held in position by suitable fasteners such as bolts 51. An intermediate portion 52 of the shaft 40 is attached by any suitable means, such as splines, not shown, in driving relationship with the rotor 34.

The vanes 38 are of the well-known intervane type more fully described in U.S. Pat. No. 2,967,488 issued to D. B. Gardiner, hereby incorporated by reference, and include a reaction member 54 disposed within each vane 38 for telescopic movement relative to the vane for maintaining, under fluid pressure, the radially outer ends 56 of vanes 38 in slidable contact with the inner contours 30, 32 of the rings 26, 28. As described in the Gardiner patent, the rotor 34 is formed with fluid passageways 53, FIG. 4, for feeding fluid to reaction chambers 55, FIG. 1, formed between vane 38 and reaction member 54.

The plate members 20 and 22 are mirror images of each other and although only plate member 20 is described below, the description applies equally to plate member 22.

Figure 5:
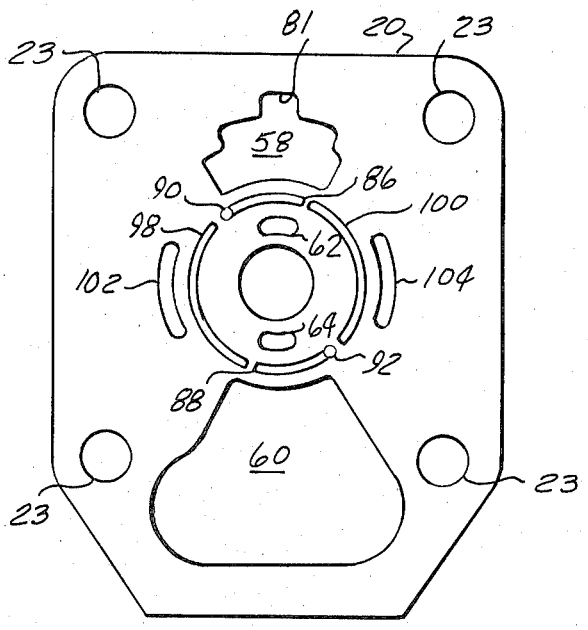
FIG. 5 is a plan view of a plate member.

As viewed in FIG. 5, plate member 20 is provided with four assembly bolt clearance holes 23 at peripheral corners thereof and includes a series of generally radially disposed arcuate-shaped openings, slots, and grooves. At the radially outermost level are diametrically opposed upper and lower inlet openings 58 and 60. Lower opening 60 is enlarged to accommodate a portion of gear system 19 described herein below. At the radially innermost level are a pair of diametrically opposed upper and lower undervane feed slots 62 and 64. Openings 58 and 60 are in communication with inlet connection 11, FIG. 1, through galleries 66 and 70, formed in inlet member 14 and an annular passageway, not shown, that connects the galleries 66, 70. Slots 62 and 64 are also in communication with galleries 66 and 70 through passageways 72 and 74. The corresponding inlet openings and undervane feed slots in plate member 22 are likewise in communication with inlet galleries 66 and 70, through slots 76 and 78 formed in liner rings 26 and 28, FIG. 4; a localized notch 80, FIG. 1, formed in center housing 24; and galleries 82 and 84 formed in outlet member 16. Notch 80 is aligned with a corresponding notch 81, FIG. 5 formed in the radially outermost periphery of inlet opening 58 of plate member 20.

Plate member 20 further includes a pair of diametrically opposed intravene feed grooves 86 and 88 positioned radially between the inlet openings 58, 60 and the inlet undervane feed slots 62, 64. An aperture 90 and 92 is formed at an end of each groove 86, 88. The apertures 90, 92 communicate with discharge fluid galleries, not shown, formed in inlet member 14 and with passages 53, FIG. 4, formed through rotor 34. Passageways 53 are in communication with intravane chambers 55, FIG. 1, formed in each of the vanes 38.

Plate member 20 also includes a pair of diametrically opposed blind intravane feed grooves 98 and 100 formed in the quadrant of plate member 20 disposed at right angles to grooves 86, 88. Blind grooves 98, 100 communicate with intravane chambers 55 through passageways 53. Blind grooves 98, 100 provide a means of slightly increasing the reaction pressure in the intravane reaction chambers 55 in the discharge portion of the pumping cycle. A pair of diametrically opposed discharge openings 102 and 104 are formed concentric with and radially outwardly of blind grooves 98 and 100. Discharge openings 102, 104 communicate with pumping chambers 39, FIG. 4, and also communicate with discharge galleries, not shown, formed in inlet and outlet members 14 and 16. These discharge galleries are connected by discharge passageways, not shown, to outlet gallery 106, FIG. 1, which communicates with outlet opening 13.

As previously mentioned, rings 26 and 28 are rotatably mounted in side-by-side relationship. Rings 26, 28 are adapted for infinitely variable rotation relative to each other in opposite directions around rotor 34 from a first or maximum displacement position, wherein the inner contours 30, 32 are in register with each other, to a moved position wherein the inner contours are out-of-register. As shown in FIG. 4, inner contours 30, 32 are in a maximum out-of-register relationship or zero displacement position. The principle of the variable displacement feature of the instant pump is well-known and fully described in the above mentioned patent to H. F. Vickers and may be described briefly as based on the principle that the sum of two sine curves which are in phase with each other is another sine curve in the same phase and that if the two sine curves are displaced equally and oppositely from their original phase by any amount, the sum of the two is a smaller sine curve, the phase relationship of which does not shift, and the amplitude of which decreases as the displacement of the two curves is increased.

In the present pump, it is believed that as vanes 38 sweep around the inner contours 30, 32, one or more vanes in one or both rows of vanes may become axially misaligned, as indicated at X in FIG. 3. The amount of axial misalignment that may occur is determined by the normal manufacturing tolerances between central housing 24, rings 26, 28, and vanes 38. As long as rings 26, 28 are in the first position, with the inner contours in register with each other, the misalignment of the vanes present no problem. However, as rings 26, 28 are rotated from the first to the moved position, inner contours 30, 32 assume the out-of-register condition, that is, they become radially displaced relative to each other forming a step Y between adjacent side faces 33 of the rings, FIG. 3. In the out-of-register condition, an edge 26 at the juncture of the ring side face and the inner contour of the ring is exposed at step Y. Unless the axial misalignment of the vane is corrected, the corner of the vane adjacent step Y may jam into edge 27.

In the normal manufacturing of conventional vanes, sharp edges are formed on the vanes between abutting surface 35 and the radially outer end 56 and are removed by well-known tumbling procedures. The tumbling process causes the sharp edges to be rounded forming a camming surface 37 on the vane between the abutting surface 35 and radially outer end 56. It is believed that the camming surface so formed provides a means for positioning the vanes 38 into tracking relationship with the inner contours 30, 32 of rings 26 and 28 by correcting the axial misalignment of the vanes.

It is believed that as camming surface 37 of a misaligned vane contacts edge 27, during the vane sweeping action, the vane is cammed axially into tracking relationship with its respective inner contour. It has been found that vanes have operated satisfactorily with an axial misalignment X of approximately 0.0015 inches (0.0381 mm) and a camming surface having a dimension W of approximately 0.003 inches (0.0760 mm). The foregoing dimensions are given as an example of one embodiment only and are not intended to limit the invention thereto, as it may be possible to satisfactorily operate the pump with vanes having significantly smaller or larger dimensions, or the camming surface may be formed by other means, such as grinding.

Alternatively, a camming surface, **37*a* may be formed on each of the rings along edge 27 as shown in FIG. 3A**, wherein like elements are assigned like reference numbers with a suffix "a".

Rings 26, 28 are connected for relative rotary adjustment between the first position and the moved position through gear system 19. Gear system 19, FIGS. 2 and 4, comprises a rack member 122; a gear segment 108 and 109 formed on the periphery of each of the rings 26, 28; first and second spaced apart pinion members 110 and 112 mounted for rotation in sleeve bearings 114 which are arranged in intake and outlet members 14 and 16; and a spring member in the form of a torsion spring 116 arranged for rotation with second pinion member 112 in a cavity 118 in outlet member 16.

Pinion members 110, 112 each have axially displaced first gears 124 and 128 and second gears 126 and 130 respectively, which extend longitudinally through enlarged opening 60 of plate members 20 and 22 parallel to pump shaft 40. Each of the first gears 124 and 128 is arranged in staggered axial relationship to each other and in alignment with and operatively engaged with gear segments 108, 109 on rings 26 and 28, respectively. The second gears 126 and 130 are arranged in axial alignment with each other and are operatively engaged with oppositely facing rack gears 132 and 134 formed on rack member 122. Rack member 122 is attached to a cylindrically-shaped differential area piston 136 of piston assembly 17, FIGS. 1 and 4, for movement therewith.

Piston assembly 17 comprises piston 136 mounted for movement in a stepped bore 138 having a reduced portion 139 formed in a piston housing 140. Reduced portion 139 opens into gallery 70 of inlet member 14 and an end cap 142 closes the opposite end of bore 138.

Piston housing 140 includes a pair of passageways 208 and 206, partially shown in FIG. 1, which terminate in spaced apart first and second annular galleries 144 and 146, respectively. Galleries 144, 146 are both formed in the periphery of and in communication with bore 138. First gallery 144 is positioned adjacent end cap 142 with second gallery 146 positioned at the juncture of reduced portion 139 of bore 138.

The differential area piston 136 includes a head portion 148 and a stepped-down portion 150 with rack member 122 extending therefrom. Head portion 148 includes an end surface 152 adjacent first gallery 144 formed with peripheral projections 154 extending in the direction of end cap 142. Peripheral projections 154 serve to space end surface 152 from end cap 142 and maintain end surface 152 in communication with first gallery 144 when piston 136 is moved so that projections 154 abut end cap 142. Piston 136 further includes an annular surface 158 formed at the juncture of head portion 148 and stepped-down portion 150 adjacent second gallery 146. An annular groove 162 formed in head portion 148 retains an O-ring 164 forming an oil seal between the first and second galleries 144 and 146. An annular groove 166 formed in the wall of reduced portion 139 of bore 138 adjacent second gallery 146 retains a O-ring 168 forming an oil seal between second gallery 146 and gallery 70 formed in inlet member 14.

Linear movement of piston 136 imparts counter rotation of pinion members 110, 112 through rack member 122. Rotation of pinion members 110, 112 in turn imparts counter rotation of rings 26, 28. The counter rotational arrangement of the gear segments and the pinions cancels out the pumping torque force acting on the rings. This torque force tends to rotate both rings in the same direction due to the pumping action of the vanes as they sweep around the inner contours of the rings and the pinions carry this force in opposite directions to the rack. Because of this the required piston force is independent of pumping torque and must overcome only the friction and inertia forces of the piston, gears, and rings.

As mentioned above, torsion spring 116 is arranged for rotation with second pinion member 112, FIG. 2. To this end torsion spring 116 is formed with a first tang portion 123 which engages with a slot 121 formed in an end 120 of second pinion member 112. A second tang portion 125 of spring 116 is anchored in a slot 127 formed in an adjustment member 129. The force exerted by torsion spring 116 is adjusted by rotation of adjustment member 129 within a bearing block 131 mounted in cavity 118. A lock nut 133 threaded on a stem end 135 of adjustment member 129 serves to hold the desired force setting of torsion spring 116. Torsion spring 116 serves to assist piston 136 in returning rings 26, 28 to the first or full delivery position in the event of low or no discharge pressure from pump 10. In the full delivery position, the rotational travel of torsion spring 116 is limited by the projections 154 on piston 136 abutting against end cap 142.

Movement of piston 136 is controlled by the discharge fluid pressure of pump 10 through compensator valve 15, FIG. 1. Valve 15 includes a valve body 170 having a spring chamber 172 in communication with a spool bore 176 which terminates at an end 178 of body 170. A valve spring 180 in spring chamber 172 is mounted for movement therein on a spring retainer 183. An adjustment plug 184 closes spring chamber 172 forming a seat for valve spring 180. A spool 186, having first and second lands 188 and 190, is mounted for sliding movement within bore 176. A sealing plug 192 closes spool bore 176 at end 178 of valve body 170. First land 188 is positioned intermediate of sealing plug 192 and spring retainer 183. Second land 190 is positioned adjacent the spring retainer 183.

Extending through valve body 170 from spool bore 176 is a first passage 200 positioned adjacent end 178, a second passage 202 positioned intermediate of the length of spool bore 176, and a third passage 203 positioned adjacent spring chamber 172. First passage 200 is connected to second gallery 146 of piston assembly 17 and to the discharge side of the pump through passageway 206, only partially shown in FIG. 1, formed in inlet member 14 and in piston housing 140. Second passage 202 is connected to first gallery 144 of piston assembly 17 through passageway 208, only partially shown, formed in inlet member 14 and in piston housing 140. Third passage 204 is connected to inlet through gallery 70.

Figure 9:
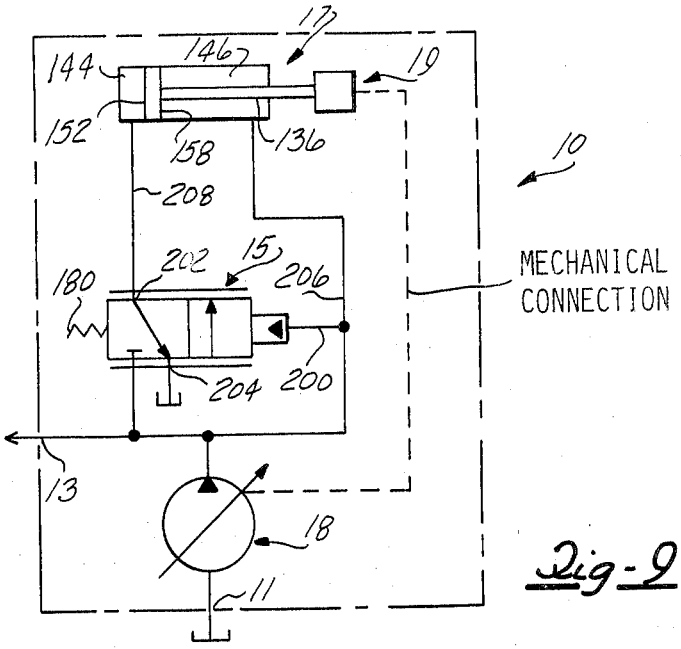
FIG. 9 is a schematic diagram showing the hydraulic circuit of a pressure compensated mode of pump operation.

In the operation of the compensator valve 15, as shown schematically in FIG. 9, the spool 186 is balanced between the discharge fluid pressure of pump 10 and the force exerted on spool 186 by valve spring 180.

With no discharge pressure, torsion spring 116 moves rings 26, 28 to full delivery position. As discharge pressure builds up, it acts against the end of spool 186 through first passage 200 and against annular surface 158 of piston 136. When discharge pressure is high enough to overcome the force exerted on the spool 186 by valve spring 180, spool 186 is displaced sufficiently to open communication between passage 200 and passage 202 wherein fluid under discharge pressure is ported to the first gallery 144 through passage 202. As the pressure in gallery 144 builds up sufficiently to overcome the force of the torsion spring acting on piston 136 and the force of the pressure acting on annular surface 158, piston 136 will move to rotate rings 26, 28 toward the minimum displacement position. Since the area of end surface 152 is greater than the area of annular surface 158, the fluid in second gallery 146 will be forced out and will join the discharge flow. When the first land 188 moves across second passage 202, communication of fluid from first gallery 144 to tank is blocked. The force of valve spring 180 is adjusted to a predetermined maximum setting through adjustment plug 184, so that, when pump discharge pressure reaches the maximum setting, the first land 188 fully uncovers passage 202 and piston 136 moves rings 26, 28 toward the zero displacement position shown in FIGS. 1 and 4, and the pump flow is reduced to an amount sufficient to maintain internal leakage flow at the predetermined maximum pressure setting.

If the pump discharge pressure falls off when external flow demand increases, valve spring 180 moves the spool 186 back toward sealing plug 192 until first land 188 opens communication between passages 202 and 204. Under this condition, fluid in first gallery 144 is ported to inlet through third passage 204 and pressure in the first gallery 144 will drop below the pressure in second gallery 146. The pressure in the second gallery 146 along with the force exerted by torsion spring 116 moves piston 136 in the direction of end cap 142 and rings 26 and 28 move toward the maximum or full displacement position.

The compensator control valve, thus, adjusts the pump output to whatever is required to develop and maintain a predetermined pressure setting.

Figure 10:
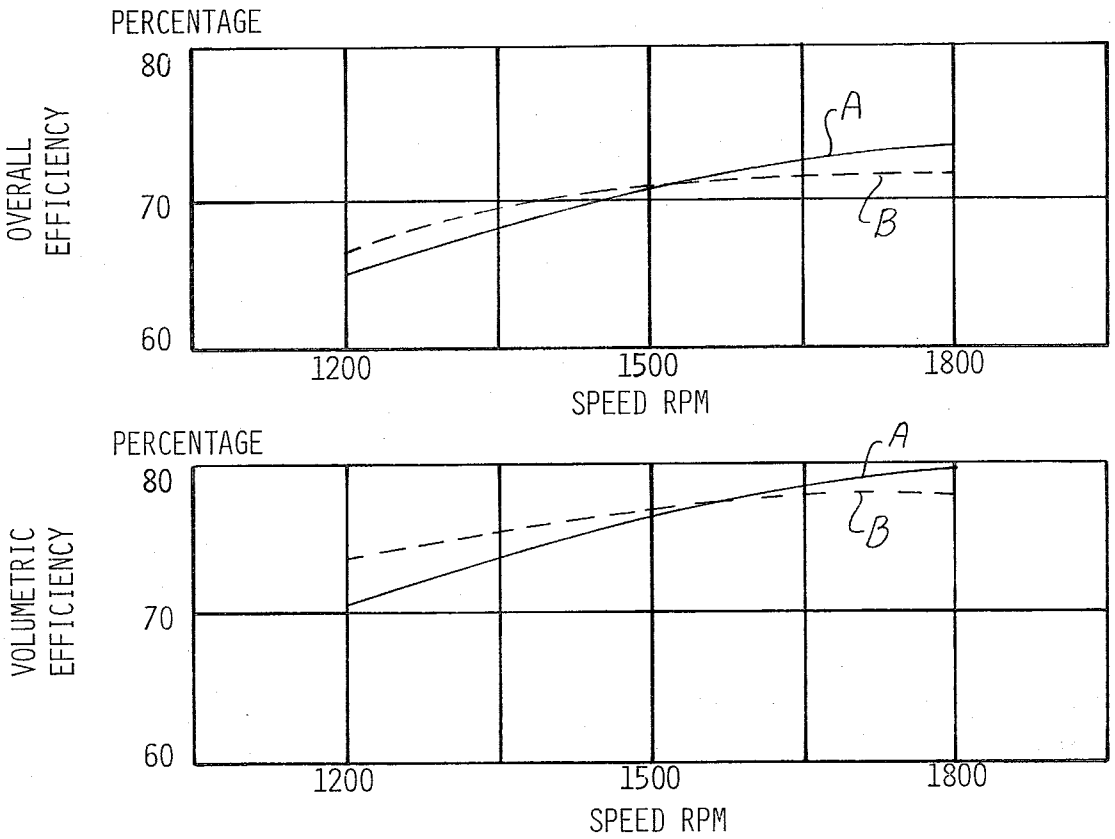
FIG. 10 is a graphical representation of the volumetric and overall efficiencies of a comparable conventional fixed displacement vane pump and the pump of the instant invention.

As has been previously mentioned, an advantage of the pump of the instant invention is that the overall and volumetric efficiencies approach that of comparable conventional fixed displacement vane pumps. FIG. 10 depicts graphically a comparison of test data between the pump of the instant invention and a Sperry Vickers Model 25VQ17 fixed displacement vane pump manufactured by Sperry Vickers, 1401 Crooks Road, Troy, Michigan. Both pumps have a nominal delivery rating of 17 gallons per minute (GPM) at 1,200 revolutions per minute (RPM) and 100 pounds per square inch (PSI) discharge pressure, with fluid having a Society of Automotive Engineers (SAE) rating of 10 W ad operating at a temperature of 180° F. with the pump inlets at 14.7 PSI atmospheric pressure.

In the graphs shown in FIG. 10, solid line A represents the performance curve of the 25VQ17 pump and dotted line B represents the comparable performance curve of a pump built in accordance with the above described invention. Both pumps were tested with the inlets at 14.7 PSI atmospheric pressure and outlets at 3,000 PSI with an SAE 10 W fluid at 180° F. In the upper graph of FIG. 10, showing the overall efficiency of the pumps, the numerical values are approximately 65%, 71%, and 74% at 1,200 RPM, 1,500 RPM, and 1,800 RPM, respectively, for line A, and 67%, 71% and 72% at 1,200 RPM, 1,500 RPM, and 1,800 RPM respectively for Line B. The numerical values of the volumetric efficiency shown in the lower chart of FIG. 10 are approximately 71%, 76%, and 80% at 1,200 RPM, 1,500 RPM, and 1,800 RPM, respectively, for line A and 74%, 77%, and 78% at 1,200 RPM, 1,500 RPM, and 1,800 RPM, respectively, for line B.

Another advantage of the invention resides in utilizing the one piece rotor. In so doing, standard production rotors used in conventional fixed displacement vane pumps having a comparable rating may be employed in the instant invention. The use of the same rotors as used for fixed displacement vane pumps reduces cost by spreading fixed manufacturing costs over a greater number of units. The standard production rotor permits use of the conventional intra-vane system described in the above mentioned Gardiner patent resulting in improved high pressure operation under severe conditions, such as pressures at 3,000 PSI and fluid temperatures at 200° F., and improved ring and vane wear.

Still another advantage resides in the simplified assembly of components resulting in reduced assembly costs and a lesser number of leakage paths.

While there has been described one embodiment of the invention, it will be apparent to those skilled in the art that variations may be made within the spirit of the invention.

Figure 9C:
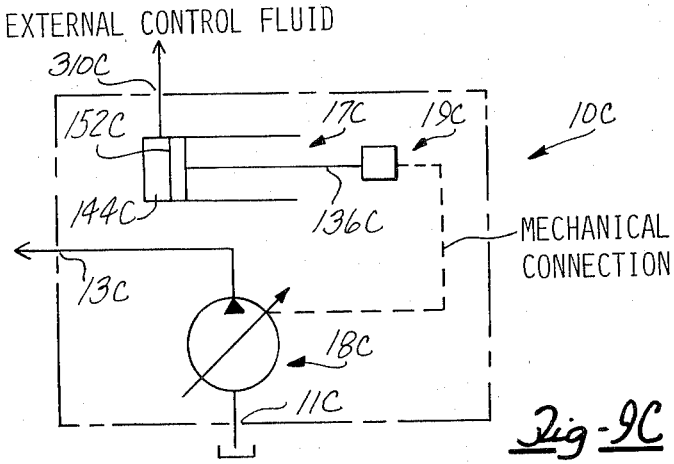
FIG. 9C is a schematic diagram of another embodiment of the hydraulic circuit of FIG. 9B with a single acting cylinder.
Figure 9A:
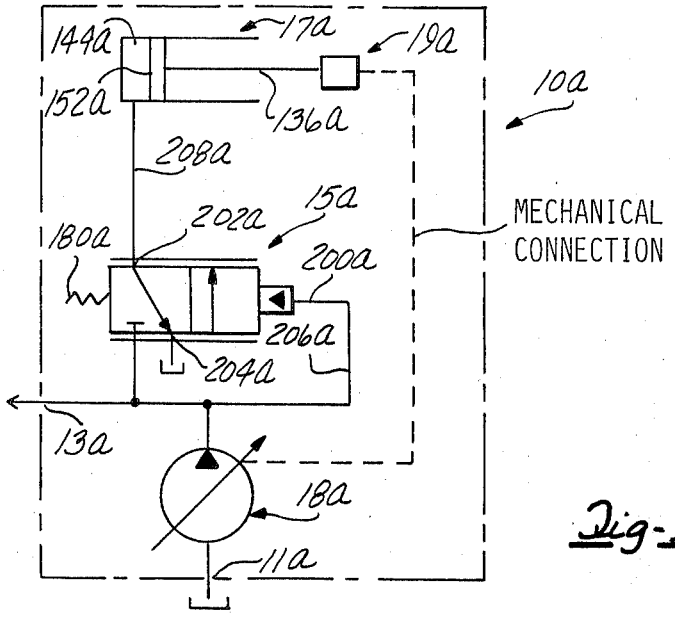
FIG. 9A is a schematic diagram of another embodiment of the hydraulic circuit of FIG. 9 with a single acting cylinder.
Figure 9B:
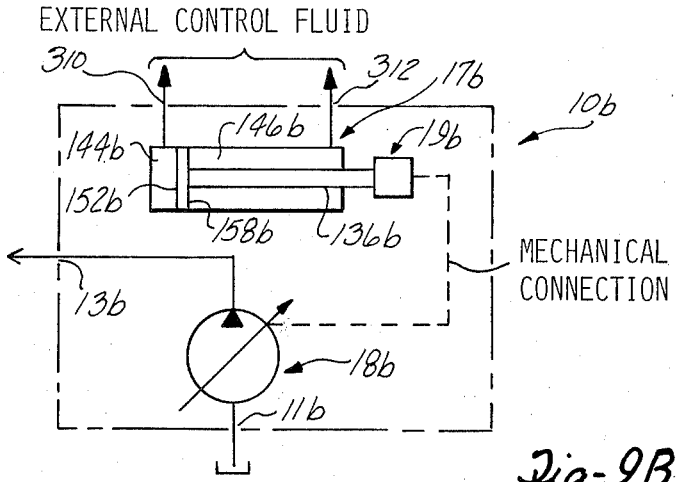
FIG. 9B is a schematic diagram of another embodiment of the hydraulic circuit of FIG. 9 in a non-pressure compensated mode of pump operation.

As an example of such variations, the invention envisions control of the variable displacement pump as shown schematically in FIGS. 9A, 9B, and 9C wherein like elements are identified by like reference numerals with the suffix "a", "b", or "c" respectively.

In the variation shown in FIG. 9A, piston assembly 17 is modified from a differential area double acting piston member 136 to a single acting piston member 136*a*, and connection 206 to gallery 146 from the valve assembly 15 is eliminated. Operation of this variation is similar to that described above except that fluid under pump discharge pressure is not available for returning piston member 136*a* from a moved position to a position corresponding to the first or maximum displacement position of the rings. When the valve 15*a* is shifted to the position shown in FIG. 9A, a spring member, similar to the one previously described herein above, acting within gear system 19*a* supplies the force required to return the piston 136*a* toward the maximum displacement position.

In FIG. 9B, the compensator valve 15 is eliminated and in gear system 19*b*, spring 116 used in gear system 19 is eliminated. Added external connections 310 and 312 communicate a source of external control fluid with galleries 144*b* and 146*b*, respectively, in piston assembly 17*b*. In this arrangement the discharge fluid from the pump 10*b* is not used to control the relative position of the rings, and the assistance of spring 116 is not required to rotate the rings from a zero displacement position. In operation when it is desired to decrease pump displacement, external control fluid is metered through connection 310 into gallery 144*b*. The pressure of the entering fluid acts on first piston area 152*b* to move the piston 136*b* to the right as viewed in FIG. 9B and fluid in gallery 146*b* is vented externally of pump 10*b* through connection 312. When it is desired to return pump 10*b* to a position for increased displacement, external control fluid is metered through connection 312 into gallery 146*b*. The pressure of the entering fluid acts on second piston area 158*b* to move the piston to the left and fluid in gallery 144*b* is vented external of the pump through connection 310.

In FIG. 9C piston assembly 17 is modified from a differential area double acting piston member 136 to a single acting piston member 136*c* and compensator valve 15 is eliminated. Added external connection 310*c* communicates a source of external control fluid with gallery 144*c*. In operation when it is desired to decrease pump displacement, external control fluid is metered through connection 310*c* into gallery 144*c*. The pressure of the entering fluid acts on piston area 152*c* to move the piston 136*c* to the right as viewed in FIG. 9*c*. When it is desired to return pump 10*c* to a position for increased displacement, the fluid in gallery 144*c* is vented externally through connection 310*c* and the spring in gear system 19*c* moves the piston 136*c* to the left.

Figure 6:
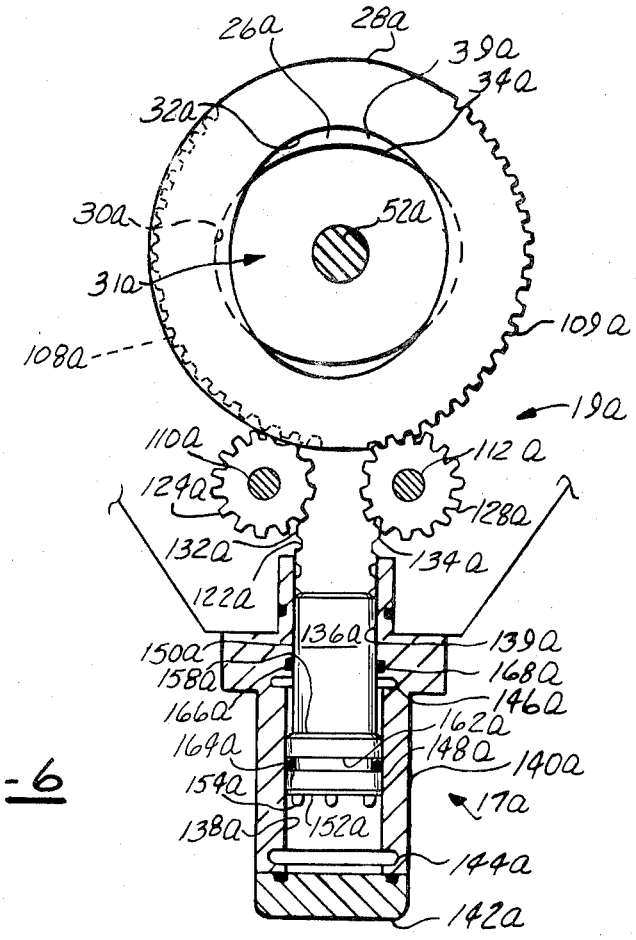
FIG. 6 is a modification of the gearing arrangement shown in FIG. 4 with additional details removed for the sake of clarity.

As another example of such variations, the invention envisions a variable displacement pump wherein the pump output capacity is reversible in direction. The reversability may be incorporated by extending the gear segments on each of the rings, correspondingly increasing the number of teeth in the rack gears, and increasing the stroke of the rack member. Or preferably, as shown in FIG. 6, wherein like elements use like reference numerals with the suffix "a", rings 26*a* and 28*a* are provided with extended gear segments 108*a* and 109*a*. Instead of extending the stroke of the piston element as mentioned above, pinion members 110*a* and 112*a* are formed with an approximate two to one gear ratio between the first gears 124*a* and 128*a* and second gears, 126*a* and 130*a*. Only gears 124*a* and 128*a* are shown in FIG. 6 for the sake of clarity. The foregoing alternate construction has the advantage of maintaining a relatively short piston stroke. However, it is to be understood that the gear ratio may be varied to achieve a longer or shorter piston stroke and the area of end surface 152*a* and annulus surface 158*a* may be varied to maintain, increase, or decrease the force exerted by the piston on the gear system.

With either of the above described variations, the rings may be moved from the above mentioned second position to another moved position, wheren the inner contours of the rings are again in register to each other but transposed from the first position for pumping full capacity through the pump in a direction opposite to that of the above mentioned first position.

Figure 8:
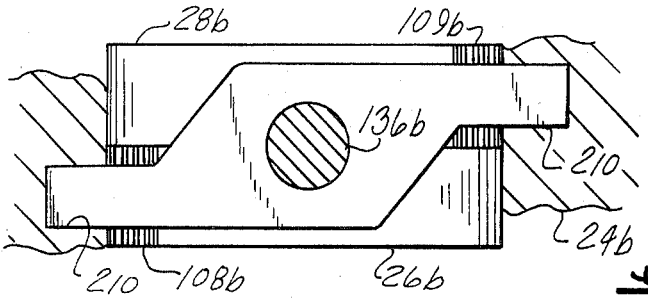
FIG. 8 is a diagrammatic partial cross-sectional view looking along line 8—8 of FIG. 7.
Figure 7:
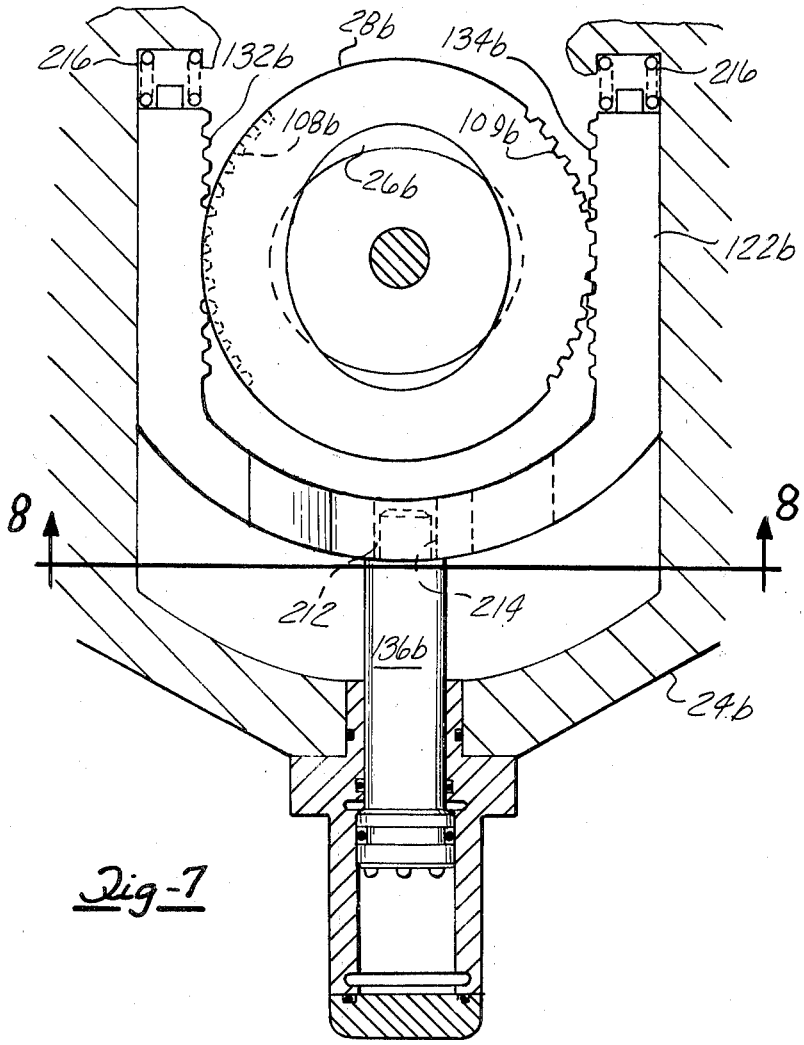
FIG. 7 is a diagrammatic partial cross sectional view similar to FIG. 4 with unnecessary details removed showing another embodiment of a gearing arrangement.

In another variation of the invention, gear system 19 is replaced with a yoke-shaped rack member 122*b*, see FIGS. 7 and 8, wherein elements similar to those previously described are identified by like reference numerals with suffix "b" added thereto. Yoke member 122*b* is supported for linear movement in tracks 210 formed in a center housing 24*b* and is attached to a piston element 136*b*, for example, by threaded engagement between an externally threaded portion 212 of piston 136*b* and an internally threaded portion 214 of yoke member 122*b*. Yoke member 122*b* is formed with a pair of facing rack gears 132*b* and 134*b*. The rack gears are on offset planes with respect to each other and are aligned with and in operative engagement with gear segments 108*b* and 109*b* formed on the periphery of rings 26*b* and 28*b*, respectively. A pair of spring members 216 are arranged in center housing 24*b* in engagement with ends of the rack gears 132*b* and 134*b*.

In the operation of the yoke member arrangement, linear movement of the piston element 136*b* effects relative rotation of rings 26*b* and 28*b* through yoke member 122*b* between the first position and moved positions, previously mentioned, with spring members 216 acting on yoke member 122 resiliently urging rings 26*b* and 28*b* from the moved position toward the first position.

However, it is to be understood that the foregoing variations are sumbitted by way of example only and are not intended to limit the spirit of the invention or the scope of the appended claims.

What is claimed is:

1. A variable displacement vane pump comprising
a casing having an inlet and an outlet,
a cavity formed in said casing between said inlet and said outlet
a pair of rings having oval-shaped inner contours and rotatably mounted in said cavity in side-by-side relationship,
said rings being adapted for relative rotation to each other between a first position wherein said inner contours are in register and a moved position wherein said inner contours are out-of-register,
a rotor mounted in said cavity for rotation within said rings and having a plurality of circumferentially spaced recesses,
a pair of vanes movably mounted in abutting relationship in each of said recesses and adapted for slidable contact with said inner contours of the rings,
means operatively connected to said rings for effecting said relative rotation comprising
gear segments formed on said rings,
a pair of pinion members rotatably mounted in said casing in operative engagement with said gear segments,
a rack member having linear rack gears in operative engagement with said pinion members,
and said rack member being movable substantially radially of said rings.

2. The pump set forth in claim 1 wherein said rack gears are oppositely facing.

3. The pump set forth in claim 1 including means for moving said rack member comprising a piston assembly including a piston axially aligned with and fixed to said rack member.

4. The pump set forth in claim 3 wherein said means for effecting said relative rotation include a compensator value operatively connected to piston assembly for maintaining a predetermined maximum fluid pressure.

5. The pump set forth in claim 3 wherein said first position comprises a maximum displacement position and said second position comprises a minimum displacement position including means for resiliently urging said rings from said moved position toward said first position to assist said piston assembly in moving said rings toward said first position.

6. The pump set forth in claim 5 wherein said means for resiliently urging said rings comprises a torsion spring in operative engagement with one of said pinion members.

7. The pump set forth in claim 5 wherein said rack member is yoke-shaped and said rack gears face one another.

8. The pump set forth in claim 7 wherein said means resiliently urging said rings comprises compression springs acting on said rack member.

9. The pump set forth in claim 1 wherein means are provided for positioning said vanes into tracking relationship for said slidable contact with said inner contours and for maintaining axial alignment of said vanes when said inner contours are in said out-of-register position.

10. The pump set forth in claim 9 wherein said vanes include an abutting surface and a radial outer end, and said positioning means comprise a camming surface formed on said vanes between said abutting surface and said radial outer end.

11. The pump set forth in claim 9 wherein said rings include a side face and an edge formed at the juncture of said inner contours and said side face, and said positioning means include a camming surface formed on said rings along said edge.

* * * * *